United States Patent [19]

Lyudkovsky

[11] 4,421,574

[45] Dec. 20, 1983

[54] METHOD FOR SUPPRESSING INTERNAL OXIDATION IN STEEL WITH ANTIMONY ADDITION

[75] Inventor: Grigory Lyudkovsky, Hammond, Ind.

[73] Assignee: Inland Steel Company, Chicago, Ill.

[21] Appl. No.: 299,807

[22] Filed: Sep. 8, 1981

[51] Int. Cl.[3] ..... H01F 1/04

[52] U.S. Cl. ..... 148/111; 148/120; 148/12 A

[58] Field of Search ..... 148/120, 121, 122, 12 A, 148/111, 6

[56] References Cited

U.S. PATENT DOCUMENTS

| | | | |
|---|---|---|---|
| 3,908,432 | 9/1975 | Ichiyama et al. | 148/111 |
| 3,932,234 | 1/1976 | Imanaka et al. | 148/111 |
| 3,933,537 | 1/1976 | Imanaka et al. | 148/112 |
| 4,174,235 | 11/1979 | Fiedler | 148/111 |
| 4,204,890 | 5/1980 | Irie et al. | 148/111 |
| 4,268,326 | 5/1981 | Iwayama et al. | 148/12 A |
| 4,280,856 | 7/1981 | Inokuti et al. | 148/111 |

FOREIGN PATENT DOCUMENTS

| | | | |
|---|---|---|---|
| 50-109118 | 2/1974 | Japan | 148/111 |
| 52-77817 | 6/1977 | Japan | 148/111 |
| 1456445 | 11/1976 | United Kingdom | 148/111 |

*Primary Examiner*—John P. Sheehan

*Attorney, Agent, or Firm*—Merriam, Marshall & Bicknell

[57] ABSTRACT

A cold rolled steel strip contains alloying elements, such as Al and Si, which have an affinity for oxygen greater than that of iron. During annealing of the strip, these alloying elements undergo oxidation to form an internal oxidation layer adjacent the surface of the strip. Formation of such an internal oxidation layer in the cold rolled steel strip is impeded by adding antimony to the steel, and depletion of the antimony prior to annealing the cold rolled strip is minimized by minimizing annealing and pickling of the strip before the strip attains substantially its final thickness.

20 Claims, No Drawings

METHOD FOR SUPPRESSING INTERNAL OXIDATION IN STEEL WITH ANTIMONY ADDITION

BACKGROUND OF THE INVENTION

The present invention relates generally to methods for producing rolled, annealed steel strip and more particularly to methods for producing cold rolled steel strip containing elements which undergo internal oxidation during annealing.

Cold rolled steel strip is produced from a relatively thick cast steel article which is subjected to a series of hot rolling steps, during which the steel article is at an elevated temperature and undergoes successive reductions in thickness to produce a relatively thin hot rolled strip which is coiled or collected, cooled to room temperature and then subjected to a cold rolling operation, conducted at room temperature, during which the steel is reduced to substantially its final thickness. Cold rolling imparts to the steel certain physical properties, such as increased hardness and strength and decreased ductility.

During production of the cold rolled steel strip, the strip conventionally undergoes an annealing operation, either between hot rolling and cold rolling, between stages of the cold rolling operation, after cold rolling or a combination thereof. Annealing is conducted at an elevated temperature (e.g., 1250°–1550° F. (682°–843° C.)), and it affects the physical properties of the steel and the ease with which a steel strip can undergo further deformation or fabrication.

Cold rolled steel strip is the basic material from which many steel parts are fabricated. In some instances where it is desirable for the fabricated part to have a very low carbon content (e.g., when the fabricated part is used in the core of an electric motor or of a transformer), a decarburizing process is conducted in conjunction with the annealing of the cold rolled strip.

Most steels contain, in addition to iron and carbon, other alloying elements for imparting to the steel certain specific properties. Some of these additional alloying elements have an affinity for oxygen greater than that of iron. For example, in an electrical steel used as the material for the core of an electric motor, silicon and aluminum are added to improve the properties of the electrical steel. Both silicon and aluminum have an affinity for oxygen greater than that of iron and, indeed, greater even than that of carbon. When these alloying elements are uncombined in the steel and the steel is subjected to an annealing operation under oxidizing conditions, the uncombined alloying elements will undergo oxidation and form an internal oxidation layer adjacent the surface of the steel product. When this occurs, the alloying elements are unavailable to perform the function for which they were added to the steel, and the properties of the steel suffer. In addition, the internal oxidation layer itself has an adverse effect on the magnetic properties of an electrical steel containing silicon and aluminum, and the adverse effect increases with an increase in the thickness of the internal oxidation layer.

An internal oxidation layer of the type described in the preceding paragraph can also form during heating incident to hot rolling, but because the steel strip is relatively thick during hot rolling, the thickness of the oxidation layer is relatively small as a percent of the strip's total thickness, and the amount of alloying element undergoing oxidation is relatively insignificant from the standpoint of the diminution of the properties of the steel for which the alloying element was added. Only when a steel strip approaches or is at its final thickness, does the thickness of the oxidation layer become significant. This condition exists after the strip has been cold rolled, either with or without temper rolling.

The more oxidizing the atmosphere in which the steel strip is heated, the more favorable are the conditions for forming an internal oxidation layer adjacent the surface of the steel product. When a steel strip is subjected to a decarburizing anneal, the conditions are very favorable to the formation of an oxidation layer adjacent the surface of the steel strip.

SUMMARY OF THE INVENTION

In accordance with the present invention, there is provided a method for reducing the depth of the internal oxidation layer which forms when a cold rolled steel strip is subjected to a heating operation under oxidizing conditions. This is accomplished by providing the steel strip with an antimony content greater than about 0.02 wt.%. When such a steel strip is subjected to a heating operation which previously has caused the formation of the above-described internal oxidation layer, a very thin antimony-enriched layer quickly forms at, and immediately adjacent, the surface of the steel strip, and there is a substantial reduction in the depth of the internal oxidation layer containing the oxides of the additional alloying elements (such as silicon and aluminum). There is also an improvement in the properties which these alloying elements impart to the steel and a decrease in the adverse effect which the internal oxidation layer has on the properties of the steel.

The antimony-enriched layer at, and immediately adjacent, the surface of the steel strip usually forms when the steel strip is subjected to an elevated temperature such as that which is attained in an annealing operation. An annealing operation is conventionally followed by a surface cleaning operation, such as pickling, which removes a thin layer of steel adjacent the surface of the steel strip, and this removed layer includes the aforementioned antimony-enriched layer. Thus when the steel strip is subjected to annealing and surface cleaning, there is a diminution in the antimony content of the steel because, during annealing, there was a concentration of antimony at the surface of the steel, and this antimony concentration is then removed during the following cleaning operation. If the antimony content becomes too low (e.g., below 0.02 wt.%), the antimony will not have a retardant effect on internal oxidation.

As noted above, it is an object of the present invention to impede the formation of an internal oxidation layer during the annealing of a steel strip which has attained substantially its final thickness. Because this is accomplished, in accordance with the present invention, by providing the steel with a small antimony content (e.g., 0.02–0.10 wt.%), it is desirable to minimize the diminution of the antimony content before the performance of the first annealing operation after completion of cold rolling. In accordance with the present invention, such a diminution of the antimony content is minimized by minimizing the annealing and surface cleaning of the steel strip before the completion of cold rolling. Thus, there should be no annealing followed by surface cleaning prior to the completion of cold rolling. More particularly, there should be no annealing between hot rolling and cold rolling and no intermediate annealing between cold rolling stages. Annealing is permissible after the steel strip has attained its substantially final cold rolled thickness. The term "substantially final cold rolled thickness" refers to the strip thickness after cold rolling and both before and after temper rolling.

Other features and advantages are inherent in the method claimed and disclosed or will become apparent to those skilled in the art from the following detailed description.

DETAILED DESCRIPTION

Typical examples of the present invention will be described in connection with steel containing, as uncombined additional alloying elements having an affinity for oxygen greater than that of iron, aluminum and silicon. Other additional alloying elements having an affinity for oxygen greater than that of iron, and the oxidation of which, in an internal oxidation layer adjacent the surface of the steel, would be diminished in accordance with the present invention comprise elements selected from the group consisting of chromium, vanadium, titanium, zirconium, manganese, magnesium, columbium, boron and molybdenum.

In accordance with an embodiment of the present invention, a typical example of a steel containing silicon and aluminum as additional alloying elements has the following base composition, in weight percent:

carbon: up to 0.06,
manganese: 0.20–0.75,
silicon: 0.15–2.50,
aluminum: 0.15–0.50,
phosphorus: 0.12 max.,
sulfur: 0.02 max.,
iron: essentially the balance.

To the base composition set forth above, there is added an antimony content of at least 0.02 wt.%. Below 0.02 wt.%, antimony does not have a substantial beneficial effect from the standpoint of reducing the depth of the internal oxidation layer containing oxides of aluminum and silicon or of improving the magnetic properties of the steel. At 0.04 wt.% antimony there is a pronounced increase in the magnetic properties of the steel for which silicon and aluminum are added, e.g., permeability (in an electrical steel sense).

The sulfur content affects the concentration of antimony in the antimony enriched layer at, and immediately adjacent, the surface of the steel product. Increasing the sulfur content decreases the antimony concentration, and this will be discussed subsequently in greater detail.

The higher the phosphorus content, the more difficult it is to hot roll the steel, and this difficulty is aggravated in the presence of antimony. Therefore, phosphorus is preferably maintained at a low end of the permissible phosphorus range, e.g., below 0.04 wt.%.

Molten steel having the above-described base composition and containing antimony in the amount described above is solidified into an ingot or into a continuously cast slab, either of which is then subjected to a conventional hot rolling operation in which the steel article is reduced to a hot rolled steel strip having a predetermined thickness.

The hot rolling procedure is essentially conventional and comprises pickling upon the completion of hot rolling to improve the surface characteristics of the strip. Following hot rolling, the strip is coiled at an elevated temperature within the range 1250°–1400° F. (682°–760° C.), for example. After coiling, the strip is allowed to cool to room temperature and then is subjected to cold rolling. During cold rolling, the strip is subjected to a reduction of about 65–80%, for example, and the strip is cold rolled down to a thickness of about 0.018–0.025 inches, for example.

There is no annealing operation between hot rolling and cold rolling, and there is no intermediate annealing operation between various cold rolling stages in the cold rolling operation. Accordingly, there is no heating procedure between the completion of hot rolling and the attainment by the cold rolled steel strip of its substantially final cold rolled thickness which could affect the surface of the steel so as to require surface cleaning.

After cold rolling, the steel strip typically is subjected to a continuous annealing step in which the steel strip is at a strip temperature in the range 1250°–1400° F. (682°–760° C.) for about 2–5 minutes. After this annealing operation, the cold rolled steel strip has an average ferritic grain size of about 8–10 ASTM. The continuous anneal is conducted in an atmosphere and under conditions which do not substantially adversely affect the surface of the cold rolled steel strip. Therefore, no pickling is required or performed in conjunction with the continuous anneal. During the relatively short time period (2–5 minutes) of the continuous anneal, an antimony enriched layer starts to form at, and immediately adjacent, the surface of the steel strip, but this layer does not attain, during the continuous anneal, a final concentration or thickness.

After the strip has cooled following continuous annealing, the strip is subjected to temper rolling to produce a reduction of about 6–8.5%. As a result of the temper rolling step, there is imparted to the steel strip sufficient strain to provide an average ferritic grain size in the range of about 2–4 ASTM, when the steel strip is subjected to a subsequent decarburizing anneal.

After temper rolling, the steel strip is shipped to a customer for fabrication into laminations for use in the core of an electric motor. The customer stamps core laminations from the cold rolled steel strip and then anneals the core laminations in a decarburizing atmosphere to reduce the carbon content of the steel to less than about 0.01 wt.% and produce therein an average ferritic grain size in the range of about 2–4 ASTM.

Decarburization annealing is conducted at a strip temperature in the range 1400°–1550° F. (760°–843° C.) for about 1–2 hours in a conventional decarburizing atmosphere. During the decarburizing anneal the antimony-enriched layer at and immediately adjacent the surface of the strip builds up to a final thickness of about 100 Angstroms ($10^{-6}$ cm). The antimony-enriched layer attains its final thickness in less than thirty minutes when the strip is heated within the above-noted temperature range.

As noted above, the sulfur content affects the concentration of antimony in the aforementioned antimony-enriched layer. More particularly, at 0.005 wt.% sulfur, the antimony content in that layer constitutes 50% of the elements having an atomic weight above 30. At 0.01 wt.% sulfur, the antimony content is 42% of the elements having an atomic weight above 30, and at 0.016 wt.% sulfur, the antimony content is 27% of the elements having an atomic weight above 30. For all sulfur contents below 0.02 wt.%, the antimony is much more concentrated in the surface-adjacent layer than it is throughout the remainder of the steel strip, and there is a significant reduction in the depth of the internal oxidation layer containing oxides of silicon and aluminum.

As previously indicated, following hot rolling, the steel strip is subjected to a surface cleaning operation, such as pickling. To the extent that an antimony-enriched layer forms during hot rolling, that antimony-enriched layer will be removed during the following pickling operation. However, the antimony-enriched layer begins to form again immediately when the steel strip is subjected to continuous annealing immediately following cold rolling. The partial antimony-enriched layer which forms during the continuous anneal functions in the same manner as the final antimony-enriched layer which forms during the subsequent decarburizing anneal, to reduce the depth of any internal oxidation layer containing oxides of silicon and aluminum.

Prior to the time the steel strip assumes its substantially final cold rolled thickness, the formation of an internal oxidation layer containing oxides of silicon and aluminum is not a problem from the standpoint of having an adverse effect on the properties for which the silicon and aluminum are added. Therefore, forming an antimony-enriched layer at and adjacent the surface of the steel strip, at a time before the steel strip assumes its substantially final cold-rolled thickness, for the purpose of reducing the depth of the above-mentioned internal oxidation layer, is unnecessary. Moreover, when such a steel strip is pickled, there is a diminution of the antimony content subsequently available for the formation of an antimony-enriched layer, i.e., after the steel strip has attained its substantially final cold rolled thickness.

As noted above, internal oxidation is retarded in accordance with the present invention by providing the steel with a relatively small antimony content (e.g., 0.02–0.10 wt.%), and a diminution of the antimony content will decrease the retardant effect of antimony. Therefore, it is desirable to conduct the processing of the steel strip in a manner which minimizes the annealing and surface cleaning of the steel strip before the completion of cold rolling, thereby minimizing the diminution of the antimony content before the performance of the first annealing operation after completion of cold rolling.

The formation of an antimony-enriched layer at and adjacent the surface of the steel will prevent the internal oxidation of all alloying elements having an affinity for oxygen greater than iron, but only to the extent that these alloying elements are uncombined in the steel at a time before the formation of the antimony-enriched layer. If the alloying element is already present in a combined state as a nitride or oxide, the formation of the antimony-enriched layer will not change the combined alloying element to its uncombined state. In vacuum degassed steels, in which all of the oxygen-affinitive alloying elements are uncombined with either oxygen or nitrogen, the oxidation-retarding effect of the antimony would be maximized. Vacuum degassing reduces the carbon content to about 0.005 wt.%, and such a steel would probably not require a decarburizing anneal after cold rolling, although a non-decarburizing anneal may be appropriate. Steel which has not been vacuum degassed generally contains greater than 0.02 wt.% carbon, and a decarburizing anneal would be appropriate for this steel.

An antimony-enriched layer at and adjacent the surface of the steel, in accordance with the present invention, will form whenever the steel is subjected to a heating operation at a temperature in the range normally employed for a decarburizing anneal (e.g., 1400°–1550° F. (760°–843° C.)), and the antimony-enriched layer will begin to form almost immediately upon being subjected to a temperature in that range. Lower temperatures will suffice so long as they cause the formation of the antimony-enriched layer.

As noted above, antimony retards the formation of an oxidation layer containing aluminum and silicon, and thus retards the oxidation of aluminum and silicon, but the antimony does not have an adverse effect on the decarburization rate when the steel is subjected to a decarburization anneal.

The exemplary embodiment of the invention described above relates to a so-called "semi-processed" steel strip on which the customer who performs the fabricating operation also performs the decarburizing anneal. In a semi-processed condition, the steel strip has been subjected to an annealing operation between cold rolling and temper rolling.

In another embodiment of the present invention, the steel strip is shipped to the customer immediately after cold rolling, without being subjected to annealing or temper rolling thereafter. A steel strip in this condition is described as "full hard." The other processing conditions described above in connection with the semi-processed steel strip are also applicable to the full hard steel strip. The customer stamps a part from the full hard steel strip and then subjects it to a decarburizing anneal. As received by the customer, the full hard, cold rolled steel strip has an average ferritic grain size of about 11–13 ASTM.

In a third embodiment of the present invention, the cold rolled steel strip is subjected to a normalizing anneal, after the cold rolling step, in an oxidizing atmosphere, to partially decarburize the steel from a carbon content in the range of 0.02–0.06 wt.% to a carbon content below 0.02 wt.% but usually above 0.01 wt.%. A steel strip in this condition is known as "annealed lust." After such an annealing, the steel strip has an average ferritic grain size of about 6–8 ASTM. A subsequent decarburizing anneal may be conducted by the customer after the customer has fabricated a part from the steel. The customer's decarburizing anneal reduces the carbon content of less than 0.01 wt.% and produces an average ferritic grain size in the range of about 4–6 ASTM.

In all the embodiments of the present invention, the avoidance of annealing and surface cleaning (e.g., pickling) before the completion of the cold rolling operation is an important aspect. There is no more than one surface cleaning operation performed after the completion of hot rolling. Avoiding annealing between hot rolling and cold rolling and/or between cold rolling stages avoids subjecting the strip to an environment which can create surface conditions on the strip necessitating the employment of surface cleaning operations, such as pickling, before the strip attains its substantially final cold rolled thickness.

Other examples of steel compositions which may be employed in a cold rolled steel strip in accordance with the present invention are set forth below:

| | Composition, Wt. % | | | | | | |
|---|---|---|---|---|---|---|---|
| Steel | C | Mn | Si | S | P | Al | Sb |
| A | 0.060 | 0.36 | 1.08 | 0.016 | — | 0.28 | 0.091 |
| B | 0.045 | 0.35 | 1.08 | 0.011 | — | 0.28 | 0.088 |

-continued

| Steel | C | Mn | Si | S | P | Al | Sb |
|---|---|---|---|---|---|---|---|
| | | Composition, Wt. % | | | | | |
| C | 0.040 | 0.35 | 1.08 | 0.003 | — | 0.26 | 0.090 |

In all of these compositions, iron constitutes essentially the balance.

The foregoing detailed description has been given for clearness of understanding only, and no unnecessary limitations should be understood therefrom, as modifications will be obvious to those skilled in the art.

I claim:

1. In a process employing hot rolling and cold rolling for making a rolled steel product containing iron, carbon and at least one uncombined additional alloying element having an affinity for oxygen greater than that of iron, with said steel product being intended for subjection, in its cold rolled state, to at least one heating operation which causes oxidation of said uncombined alloying element in an internal oxidation layer adjacent the surface of said steel product, and wherein said uncombined alloying elements comprise silicon and aluminum included in said steel product to improve the magnetic properties thereof, a method for reducing the depth of said internal oxidation layer, said method comprising:

providing the steel product with an antimony content of at least about 0.02 wt.% and which will form, upon the performance of such a heating operation, an antimony-enriched layer at, and immediately adjacent, the surface of said steel product;

and minimizing the surface cleaning of said steel product before the completion of said cold rolling to minimize diminution of the antimony content before the performance of the first such heating operation after said completion of the cold rolling there being no annealing step prior to the completion of cold rolling.

2. In a process as recited in claim 1 wherein:

one of said heating operations comprises a decarburizing operation;

and there is no more than one surface cleaning operation performed after the completion of said hot rolling step and prior to said decarburizing operation.

3. In a process as recited in claim 2 wherein:

there is a temper rolling step after said cold rolling step;

and no more than one annealing operation is performed between said cold rolling step and said temper rolling step.

4. In a process as recited in claim 1 wherein said internal oxidation layer, the depth of which is reduced, comprises oxides of aluminum and silicon.

5. In a process as recited in claim 1 wherein said antimony content is in the range of about 0.02–0.10 wt.%.

6. In a process as recited in claim 1 wherein said antimony content is at least about 0.04 wt.%.

7. In a process as recited in claim 1 wherein said steel product contains, in wt.%, 0.15–2.50 silicon and 0.15–0.50 aluminum.

8. In a process as recited in claim 1 wherein said steel product contains 0.15–0.50 wt.% aluminum.

9. A method for producing a cold rolled, temper rolled strip of electrical steel containing silicon and aluminum and which will suppress the formation of an internal oxidation layer containing oxides of silicon and aluminum adjacent the surface of said cold rolled steel strip during subsequent decarburizing after temper rolling, said method comprising the steps of:

providing a steel composition consisting essentially of, in wt.%:

carbon: up to 0.06,
manganese: 0.20–0.75,
silicon: 0.15–2.50,
aluminum: 0.15–0.50,
phosphorus: 0.12 max.,
sulfur: 0.02 max.,
antimony: 0.02–0.10 wt.%,
iron: essentially the balance, hot rolling said steel into a strip;

coiling said strip at an elevated temperature and then cooling the coiled strip;

cold rolling said strip;

annealing said strip after said cold rolling step, at a strip temperature which forms an antimony enriched layer at, and immediately adjacent, the surface of said strip;

there being no annealing step after said hot rolling step and prior to the completion of cold-rolling;

and temper rolling said strip after annealing;

there being no substantial reduction in the carbon content of said steel in any of said steps through said temper rolling step.

10. A method as recited in claim 9 wherein said method imparts to said steel strip, after said temper rolling step, sufficient strain to provide an average ferritic grain size of about 2–4 ASTM when the steel strip is subjected to a subsequent decarburizing and annealing operation.

11. A method as recited in claim 9 wherein said method provides said strip, after said first-recited annealing step, with an average ferritic grain size of about 8–10 ASTM.

12. In combination with the method of claim 9, the further steps comprising:

stamping a steel product from said cold rolled steel strip;

and heating said steel product in a decarburizing atmosphere to reduce the carbon content of the steel to less than about 0.1 wt.% and produce therein an average ferritic grain size in the range of about 2–4 ASTM;

said last-recited heating step being performed at a temperature which forms an antimony-enriched layer at, and immediately adjacent, the surface of said strip.

13. A method as recited in claim 9 wherein said antimony content is at least about 0.04 wt.%.

14. A method as recited in claim 9 wherein:

there is no more than one surface cleaning operation performed after the completion of said hot rolling step and prior to said subsequent decarburizing operation.

15. A method for producing a cold rolled strip of electrical steel containing silicon and aluminum and which will suppress the formation of an internal oxidation layer containing oxides of silicon and aluminum adjacent the surface of said steel strip during subsequent decarburizing after cold rolling, said method comprising the steps of:

providing a steel composition consisting essentially of, in wt%:

carbon: up to 0.06,
manganese: 0.20–0.75,
silicon: 0.15–2.50,
aluminum: 0.15–0.50,
phosphorus: 0.12 max.,
sulfur: 0.02 max.,
antimony: 0.02–0.10 wt.%,
iron: essentially the balance,
hot rolling said steel into a strip;
coiling said strip at an elevated temperature and then cooling the coiled strip;
cold rolling said strip;
there being no annealing step after said hot rolling step and prior to the completion of cold rolling;
there being no substantial reduction in the carbon content of said steel in any of said steps through said cold rolling step;
said method providing said cold cold rolled steel strip with an average ferritic grain size of about 11–13 ASTM.

16. A method as recited in claim 15 wherein said antimony content is at least about 0.04 wt.%.

17. A method as recited in claim 15 wherein:
there is no more than one surface cleaning operation performed after the completion of said hot rolling step and prior to said subsequent decarburizing operation.

18. A method for producing a cold rolled strip of electrical steel containing silicon and aluminum while suppressing the formation of an internal oxidation layer containing oxides of silicon and aluminum adjacent the surface of said cold rolled steel strip, said method comprising the steps of:
providing a steel composition consisting essentially of, in wt.%:
carbon: up to 0.06,
manganese: 0.20–0.75,
silicon: 0.15–2.50,
aluminum: 0.15–0.50,
phosphorus: 0.12 max.,
sulfur: 0.02,
antimony: 0.02–0.10 wt.%,
iron: essentially the balance,
hot rolling said steel into a strip;
coiling said strip at an elevated temperature and then cooling the coiled strip;
cold rolling said strip;
annealing said strip after said cold rolling step, at a strip temperature which forms an antimony-enriched layer at, and immediately adjacent, the surface of said strip;
said annealing step being conducted in an oxidizing atmosphere to partially decarburize said steel strip to a carbon content in the range of about 0.01–0.02 wt.%;
there being no annealing step after said hot rolling step and prior to the completion of said cold rolling step;
said method providing said steel strip, after said annealing step, with an average ferritic grain size of about 6–8 ASTM;
said method imparting to said steel strip sufficient strain to provide an average ferritic grain size of about 4–6 ASTM when the steel strip is subjected to a subsequent decarburizing and annealing operation.

19. A method as recited in claim 18 wherein said antimony content is at least about 0.04 wt.%.

20. A method as recited in claim 18 wherein:
there is no more than one surface cleaning operation performed after the completion of said hot rolling step and prior to said annealing step after cold rolling.

* * * * *

UNITED STATES PATENT AND TRADEMARK OFFICE

CERTIFICATE OF CORRECTION

PATENT NO. : 4,421,574

DATED : December 20, 1983

INVENTOR(S) : Grigory Lyudkovsky

It is certified that error appears in the above-identified patent and that said Letters Patent are hereby corrected as shown below:

Col. 3, line 56, "at a low" should be --at the low--;

Col. 6, line 45, "of less than" should be --to less than--;

Col. 7, line 37, after "rolling" insert --;--;

Col. 9, line 18, "cold cold rolled" should be --cold rolled--.

Signed and Sealed this

Nineteenth Day of June 1984

[SEAL]

Attest:

GERALD J. MOSSINGHOFF

Attesting Officer

Commissioner of Patents and Trademarks

US004421574C1

(12) REEXAMINATION CERTIFICATE (4598th)

United States Patent

Lyudkovsky

(10) Number: US 4,421,574 C1

(45) Certificate Issued: Jun. 18, 2002

(54) METHOD FOR SUPPRESSING INTERNAL OXIDATION IN STEEL WITH ANTIMONY ADDITION

(75) Inventor: Grigory Lyudkovsky, Hammond, IN (US)

(73) Assignee: Inland Steel Corp., Chicago, IL (US)

Reexamination Request:

No. 90/002,920, Jan. 4, 1993
No. 90/002,980, Feb. 17, 1993
No. 90/003,228, Oct. 26, 1993
No. 90/003,233, Oct. 28, 1993
No. 90/003,645, Nov. 28, 1994
No. 90/003,679, Jan. 3, 1995
No. 90/003,791, Feb. 21, 1995

Reexamination Certificate for:

Patent No.: 4,421,574
Issued: Dec. 20, 1983
Appl. No.: 06/299,807
Filed: Sep. 8, 1981

Certificate of Correction issued Jun. 19, 1984.

(51) Int. Cl.[7] ..... H01F 1/04
(52) U.S. Cl. ..... 148/111; 148/120

(56) References Cited

U.S. PATENT DOCUMENTS

| | | | | |
|---|---|---|---|---|
| 2,867,531 A | | 1/1959 | Holzwarth et al. | 75/123 |
| 3,147,157 A | | 9/1964 | Grenoble | 148/111 |
| 3,157,538 A | | 11/1964 | Imai et al. | 148/112 |
| 3,203,839 A | | 8/1965 | Takahasi | 148/113 |
| 3,287,184 A | | 11/1966 | Koh | 148/113 |
| 3,415,696 A | | 12/1968 | Gimigliano | 148/110 |
| 3,586,545 A | | 6/1971 | Stanley | 148/111 |
| 3,632,456 A | | 1/1972 | Sakakura et al. | 148/111 |
| 3,770,517 A | * | 11/1973 | Gray et al. | 148/111 |
| 3,834,952 A | | 9/1974 | Matsushita et al. | 148/112 |
| 3,853,544 A | | 12/1974 | Nishi et al. | 75/125 |
| 3,855,020 A | | 12/1974 | Salsgiver et al. | 148/112 |
| 3,867,211 A | | 2/1975 | Easton | 148/31.55 |
| 3,908,432 A | | 9/1975 | Ichiyama et al. | 72/365 |
| 3,930,906 A | | 1/1976 | Irie et al. | 148/113 |
| 3,932,234 A | | 1/1976 | Imanaki | 148/112 |
| 3,932,237 A | | 1/1976 | Irie et al. | 148/113 |
| 3,933,537 A | | 1/1976 | Imanaka et al. | 148/112 |
| 3,940,299 A | | 2/1976 | Goto et al. | 148/111 |
| 3,971,678 A | | 7/1976 | Vlad | 148/111 |
| 3,986,902 A | | 10/1976 | Regitz | 148/110 |
| 4,014,717 A | | 3/1977 | Barisoni et al. | 148/111 |
| 4,042,425 A | | 8/1977 | Ohashi | 148/111 |
| 4,046,602 A | | 9/1977 | Stanley | 148/111 |
| 4,088,513 A | | 5/1978 | Nakazawa et al. | 148/112 |
| 4,115,160 A | | 9/1978 | Benford et al. | 148/111 |
| 4,127,429 A | | 11/1978 | Ichida et al. | 148/113 |
| 4,157,925 A | | 6/1979 | Malagari, Jr. et al. | 148/111 |
| 4,190,469 A | | 2/1980 | Ichida et al. | 148/113 |
| 4,204,890 A | | 5/1980 | Irie et al. | 148/111 |
| 4,206,004 A | | 6/1980 | Ohashi et al. | 148/12.1 |
| 4,212,689 A | | 7/1980 | Shimuzu et al. | 148/111 |
| 4,242,155 A | | 12/1980 | Morito et al. | 148/113 |
| 4,251,294 A | | 2/1981 | Chatfield et al. | 148/120 |
| 4,268,326 A | | 5/1981 | Iwayama et al. | 148/113 |
| 4,280,856 A | | 7/1981 | Inokuti et al. | 148/111 |
| 4,293,336 A | | 10/1981 | Matsumura et al. | 75/124 |
| 4,306,922 A | | 12/1981 | Coombs et al. | 148/111 |
| 4,326,899 A | | 4/1982 | Henricks | 148/120 |
| 4,338,143 A | | 7/1982 | Shimoyama et al. | 148/31.55 |
| 4,390,378 A | | 6/1983 | Rastogi | 148/111 |
| 4,394,192 A | | 7/1983 | Rastogi | 148/120 |
| 4,421,574 A | | 12/1983 | Lyudkovsky | 148/111 |
| 4,483,723 A | | 11/1984 | Lyudkovsky | 148/31.5 |

FOREIGN PATENT DOCUMENTS

| | | |
|---|---|---|
| GB | 1514375 | 6/1978 |
| JP | 63-8214 | 6/1963 |
| JP | 48-19048 | 6/1973 |
| JP | 48-48318 | 7/1973 |
| JP | 49-4934 | of 1975 |
| JP | 50-29415 | 9/1975 |
| JP | 54-76422 | of 1979 |
| JP | 57-035627 | 2/1982 |

OTHER PUBLICATIONS

Metals Handbook Ninth Edition, vol. 6, p. 935, 1983.*

Morito et al. article "The Effect of Small Amounts of Manganese on the Oxidation Behavior of a 3% Silicon–Iron Alloy in Water–Hydrogen Atmospheres" published in *Corrosion Science* in 1977. vol. 17, p. 961–970.

Miyoshi et al. article "The Effects of Tin (Sn), Antimony (Sb), Arsenic (As) and Tellurium (Te) on the High–Temperature Oxidation of Carbon Steel" published in *Nippon Kinzoku Gakkaishi* (1972).

Miyoshi et al. article "Effect of Sn and Sb on the High–Temperature Oxidation Behaviour of Fe–Si Two–Element Alloy" published in *Nippon Kinzoku–Gakkai–Shi,* vol. 36, pp. 841–846 (1972).

Morito et al. article "Effect of Microalloying With Sb in High–Temperature Oxidation of Fe–3% Si Alloy in $H_2O$—$H_2$", Abstract of Reports Presented at the Spring Conference of the Japan Institute of Metallurgical Society (Apr., 1975).

Morito et al. article "Transition From External to Internal Oxidation in Iron–Silicon Alloy as a Function of Oxygen Potential of the Ambient Atmosphere" published in *Scripta METALLURGICA* vol. 10, pp 619–622 1976.

Shimanaka et al. article "Non–Oriented Si–Steels Useful for Energy Efficient Electrical Apparatus" presented at the TMS–AIME Meeting (Oct. 5–9, 1980). vol. 19, p. 63–64.

Shimanaka et al. article "A New Non–Oriented Si–Steel With Texture of {100}<ovw>" published in the *Journal of Magnetism and Magnetic Materials* 19 (1980).

(List continued on next page.)

*Primary Examiner*—William Krynski

(57) ABSTRACT

A cold rolled steel strip contains alloying elements, such as Al and Si, which have an affinity for oxygen greater than that of iron. During annealing of the strip, these alloying elements undergo oxidation to form an internal oxidation layer adjacent the surface of the strip. Formation of such an internal oxidation layer in the cold rolled steel strip is impeded by adding antimony to the steel, and depletion of the antimony prior to annealing the cold rolled strip is minimized by minimizing annealing and pickling of the strip before the strip attains substantially its final thickness.

OTHER PUBLICATIONS

Robert A. Rapp article "Kinetics, Microstructures and Mechanism of Internal Oxidation—Its Effect and Prevention in High Temperature Alloy Oxidation" *Corrosion,* vol. 21, pp. 382–401 (1965).

A.L. Geiger article "Surface Oxidation of Non–Oriented Silicon–Aluminum Electrical Steels During Annealing" J. Appl. Phys., 49(3) Mar., 1978.

*The Making, Shaping and Treating of Steel,* 10th Edition, Lankford Jr. et al., (eds.) Pittsburgh: Herbick & Held, pp. 1329–1330, 1985.

Takemoto Yamazaki article "On the Decarburization of Silicon Steel Sheet", *Transactions ISIJ,* vol. 9, pp. 66–75 (1969).

Morito et al. article "(236) High Temperature Oxidation of Fe–3%Si Alloy in $H_2O/H_2$", from the Nov. 1974 Autumn Conference of The Japan Institute of Metallurgy Society.

Schmidt et al. article "Formation of Oxid Layers on Iron–Silicon and Iron–Aluminum Alloys During Annealing Processes", *J. Magnetism and Magnetic Materials,* 13 (1979) pp. 22–26.

C.W. Tuck article "Non–Protective and Protective Scaling of a Commercial 1¾% Silicon–Iron Alloy in the Range 800° C.–1000° C.", *Corrosion Science*, vol. 5, pp. 631–643 (1965).

Miyoshi et al. article "A Study on the Internal Oxidation of Low Alloy Steels", presented at Fukuoka Meeting of the Society in Oct., 1965 and Tokyo Meeting of the Society in Apr., 1966, published in *Nipon Kinzoku–Gakkai–Shi,* 31 (4), pp. 481–485 (1972).

S.A. Bradford article "Formation and Composition of Internal Oxides In Dilute Iron Alloys", *Transactions of the Metallurgical Society of AIME,* vol. 230, pp. 1400–1406 (Oct., 1964).

Togashi et al. article "(178) Effect of Sb and Sn on the Austenite Decarburization Reaction", Papers for the 87th ISIJ Meeting, Apr. 1974.

*Metals Handbook, Ninth Edition, vol. 3, Properties and Selection: Stainless Steels, Tool Materials and Special–Purpose Metals,* chapter entitled "Magnetically Soft Materials", pp. 597–601 (1980).

Rastogi, "Effect of Sulfur on Magnetic Properties of a Semi–Processed Non–Oriented Al–Bearing Silicon Steel," presented at the TMS–AIMS meeting (Oct. 5–9, 1980) (Ex. 16).

Webster's Ninth New Collegiate Dictionary, 1989, pp. 286 and 1299 (Ex. 109).

Yamazaki, "On the Decarburization of Silicon Steel Sheet," presented at the Joint Symposium of U.S.S.R. and Japan on Physical Chemistry of Metallurgical Processes, May 1967 (Ex. 116).

Miyoshi et al., "A Study on the Internal Oxidation of Low Alloy Steels," 1967 (Ex. 120) Nipon Kinzoku–Gakkai–shi, 31 (4), pp. 48.

Excerpts from "The Making, Shaping and Treating of Steel," 1971, pp. 944–945, 959 (Ex. 138).

Ludkovsky et al., "The influence of annealing conditions on internal oxidation and magnetic properties of silicon–aluminum bearing electrical steels," J. Appl. Phys., Mar. 1982 (Ex. 144) pp. 2419–2421.

Stephenson, "The Effect of Decarburization Annealing on the Microstructure and Magnetic Properties of Semiprocessed Motor Lamination Steels," J. Materials Engineering, 1990 (Ex. 146) vol. 12, No. 1, pp. 69–83.

G.P. Huffman and E.B. Stanley, "Effect of Solute Oxidation on the Magnetic Properties of Non–Oriented Electrical Sheet Steel", J. Appl. Physics, Mar. 1979 (Ex. 12).

A.L. Geiger, "Effects of Internal Oxidation and Nitridation on the Magnetic Properties of Non–Oriented Electrical Steels," J. Appl. Phys., Mar. 1979 (Ex. 13).

Datta et al., "Oxidation of 3% Si–Fe During Decarburization", Proceedings Third International Conference on Soft Magnetic Material Proceedings, pp. 492–502 (1977).

Mulford et al., "Temper Embrittlement of Ni–Cr Steel by Antimony: III. Effects of Ni and Cr", *Metallurgical Transactions A,* vol. 7A: 1269–1274 (Sep., 1976).

Saito "Effect of Minor Elements on Normal Grain Growth Rate in Singly Oriented Si–Steel", *Nippon Kinzoki Gakkai–shi,* vol. 27, pp. 186–191 (1963).

Taguchi, "Review of the Recent Development of Electrical Sheet Steel in Japan", *Transactions ISIJ,* vol. 17: 604–615 (1977).

Yamazaki, "On the Decarburization of Silicon Steel Sheet" *Transactions ISIJ,* vol. 9: 66–75 (1969).

* cited by examiner

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–20 are cancelled.

* * * * *